US009767970B2

(12) United States Patent
Jhuang

(10) Patent No.: US 9,767,970 B2
(45) Date of Patent: Sep. 19, 2017

(54) KEY STRUCTURE

(71) Applicant: Primax Electronics Ltd., Neihu, Taipei (TW)

(72) Inventor: Chuang-Shu Jhuang, Taipei (TW)

(73) Assignee: PRIMAX ELECTRONICS LTD., Neihu, Taipei (TW)

( * ) Notice: Subject to any disclaimer, the term of this patent is extended or adjusted under 35 U.S.C. 154(b) by 0 days.

(21) Appl. No.: 15/082,657

(22) Filed: Mar. 28, 2016

(65) Prior Publication Data

US 2017/0213663 A1 Jul. 27, 2017

(30) Foreign Application Priority Data

Jan. 21, 2016 (CN) ..... 2016 1 0040401

(51) Int. Cl.

| | |
|---|---|
| ***H01H 9/00*** | (2006.01) |
| ***H01H 13/14*** | (2006.01) |
| ***H01H 13/10*** | (2006.01) |
| ***H01H 13/02*** | (2006.01) |
| ***H01H 13/52*** | (2006.01) |

(52) U.S. Cl.

CPC ..... *H01H 13/14* (2013.01); *H01H 13/023* (2013.01); *H01H 13/10* (2013.01); *H01H 13/52* (2013.01); *H01H 2215/03* (2013.01); *H01H 2221/002* (2013.01)

(58) Field of Classification Search

CPC .. H01H 3/00; H01H 3/12; H01H 5/18; H01H 5/20; H01H 13/70; H01H 13/705; H01H 2003/12; H01H 2215/03; H01H 2215/034; H01H 2221/00; H01H 2237/004; H01H 13/14; H01H 13/023; H01H 13/10; H01H 13/52; H01H 2221/002; H01H 3/02; H01H 13/00; H01H 13/20; H01H 13/22; H01H 13/26; H01H 13/36; H01H 13/50; H01H 2207/00; H01H 2207/01; H01H 2207/022

USPC ..... 200/5 A, 310, 314, 5 R, 46, 510–514, 200/520, 521, 308, 311, 312, 313, 318.1, 200/337, 341, 343, 344, 345

See application file for complete search history.

(56) References Cited

U.S. PATENT DOCUMENTS

| | | | | |
|---|---|---|---|---|
| 5,874,696 A * | 2/1999 | Hayashi | ..... | G06F 1/1616 200/345 |
| 6,091,036 A * | 7/2000 | Hu | ..... | H01H 3/125 200/344 |
| 2010/0147661 A1* | 6/2010 | Takeda | ..... | H01H 13/83 200/314 |

FOREIGN PATENT DOCUMENTS

| | | | | |
|---|---|---|---|---|
| TW | EP 0353900 B1 * | 8/1994 | ..... | H01H 13/50 |

* cited by examiner

*Primary Examiner* — Anthony R. Jimenez

(74) *Attorney, Agent, or Firm* — Kirton McConkie; Evan R. Witt

(57) ABSTRACT

A key structure includes a connecting plate, a keycap, a triggering element, a scissors-type connecting element, a membrane switch circuit member, and a supporting plate. The keycap includes a protrusion part. The supporting plate includes an accommodation part and an elastic structure. The elastic structure is aligned with the protrusion part and disposed within the accommodation part. When the keycap is depressed, the protrusion part is moved with the keycap to push the triggering element. Consequently, the membrane switch circuit member is triggered by the triggering element. Moreover, as the protrusion part is moved with the keycap, the protrusion part collides with the elastic structure to generate a sound.

12 Claims, 9 Drawing Sheets

KEY STRUCTURE

FIELD OF THE INVENTION

The present invention relates to a key structure, and more particularly to a key structure with a scissors-type connecting element.

BACKGROUND OF THE INVENTION

Generally, the widely-used peripheral input device of a computer system includes for example a mouse, a keyboard, a trackball, or the like. Via the keyboard, characters or symbols can be directly inputted into the computer system. As a consequence, most users and most manufacturers of input devices pay attention to the development of keyboards. As known, a keyboard with scissors-type connecting elements is one of the widely-used keyboards.

Hereinafter, a key structure with a scissors-type connecting element of a conventional keyboard will be illustrated with reference to FIG. 1. FIG. 1 is a schematic side cross-sectional view illustrating a conventional key structure. As shown in FIG. 1, the conventional key structure 1 comprises a keycap 11, a scissors-type connecting element 12, a rubbery elastomer 13, a membrane switch circuit member 14 and a base 15. The keycap 11, the scissors-type connecting element 12, the rubbery elastomer 13 and the membrane switch circuit member 14 are supported by the base 15. The scissors-type connecting element 12 is used for connecting the base 15 and the keycap 11.

The membrane switch circuit member 14 comprises plural key intersections (not shown). When one of the plural key intersections is triggered, a corresponding key signal is generated. The rubbery elastomer 13 is disposed on the membrane switch circuit member 14. Each rubbery elastomer 13 is aligned with a corresponding key intersection. When the rubbery elastomer 13 is depressed, the rubbery elastomer 13 is subjected to deformation to push the corresponding key intersection of the membrane switch circuit member 14. Consequently, the corresponding key signal is generated.

The scissors-type connecting element 12 is arranged between the base 15 and the keycap 11, and the base 15 and the keycap 11 are connected with each other through the scissors-type connecting element 12. The scissors-type connecting element 12 comprises a first frame 121 and a second frame 122. A first end of the first frame 121 is connected with the keycap 11. A second end of the first frame 121 is connected with the base 15. The rubbery elastomer 13 is enclosed by the scissors-type connecting element 12. Moreover, the first frame 121 comprises a first keycap post 1211 and a first base post 1212. The first frame 121 is connected with the keycap 11 through the first keycap post 1211. The first frame 121 is connected with the base 15 through the first base post 1212. The second frame 122 is combined with the first frame 121. A first end of the second frame 122 is connected with the base 15. A second end of the second frame 122 is connected with the keycap 11. Moreover, the second frame 122 comprises a second keycap post 1221 and a second base post 1222. The second frame 122 is connected with the keycap 11 through the second keycap post 1221. The second frame 122 is connected with the base 15 through the second base post 1222.

The operations of the conventional key structure 1 in response to the depressing action of the user will be illustrated as follows. Please refer to FIG. 1 again. When the keycap 11 is depressed, the keycap 11 is moved downwardly to push the scissors-type connecting element 12 in response to the depressing force. As the keycap 11 is moved downwardly relative to the base 15, the keycap 11 pushes the corresponding rubbery elastomer 13. At the same time, the rubbery elastomer 13 is subjected to deformation to push the membrane switch circuit member 14 and trigger the corresponding key intersection of the membrane switch circuit member 14. Consequently, the membrane switch circuit member 14 generates a corresponding key signal. When the keycap 11 is no longer depressed by the user, no external force is applied to the keycap 11 and the rubbery elastomer 13 is no longer pushed by the keycap 11. In response to the elasticity of the rubbery elastomer 13, the rubbery elastomer 13 is restored to its original shape to provide an upward elastic restoring force. Consequently, the keycap 11 is returned to its original position where it is not depressed.

In addition to the above keyboard with scissors-type connecting elements, another conventional keyboard with a mechanical key structure is introduced into the market. FIG. 2 is a schematic side cross-sectional view illustrating a conventional mechanical key structure. As shown in FIG. 2, the conventional mechanical key structure 2 comprises a keycap 21, a scissors-type connecting element 22, a mechanical triggering switch 23, a circuit board 24 and a base 25. The base 25 is connected with the keycap 21 through the scissors-type connecting element 22. The circuit board 24 is disposed under the base 25. The triggering switch 23 is supported by the circuit board 24. In addition, the circuit board 24 is electrically connected with the mechanical triggering switch 23. The mechanical triggering switch 23 is penetrated through the base 25 and the scissors-type connecting element 22, and contacted with the keycap 21. After the above components are combined with each other, the key structure 2 is assembled. The components of the key structure 2 from top to bottom include the keycap 21, the scissors-type connecting element 22, the base 25 and the circuit board 24 sequentially. The mechanical triggering switch 23 is arranged between the keycap 21 and the circuit board 24. In comparison with the key structure 1, the key structure 2 comprises the mechanical triggering switch 23 in replace of the rubbery elastomer 13 and the membrane switch circuit member 14.

When the mechanical triggering switch 23 is triggered by the keycap 21, a click sound is generated. Due to the click sound, the user can feel the depressing feedback. Consequently, the mechanical triggering switch 23 is favored by many users. However, for resulting in normal operation of the mechanical triggering switch 23, the circuit board 24 of the mechanical key structure 2 must be thicker than the membrane switch circuit member 14. Moreover, the mechanical triggering switch 23 is thicker than the rubbery elastomer 13. Consequently, the thickness of the conventional mechanical key structure 2 is larger than the thickness of the conventional key structure 1. Moreover, the inner portion of the mechanical triggering switch 23 comprises the components made of a metallic material and the components made of a plastic material. Consequently, when the keycap 21 is depressed, the metallic material and the plastic material in the mechanical triggering switch 23 may collide with each other. Under this circumstance, the conventional mechanical key structure 2 give a stiff feel to the user.

Therefore, there is a need of providing a key structure capable of providing a feedback feel and having enhanced tactile feel.

SUMMARY OF THE INVENTION

An object of the present invention provides a key structure capable of providing a feedback feel.

Another object of the present invention provides a key structure with enhanced tactile feel.

A further object of the present invention provides a slim-type key structure.

In accordance with an aspect of the present invention, there is provided a key structure. The key structure includes a connecting plate, a keycap, a scissors-type connecting element, and a supporting plate. The keycap is disposed over the connecting plate, and movable relative to the connecting plate. The keycap includes a protrusion part. The protrusion part is protruded from an inner surface of the keycap. The scissors-type connecting element is connected with the keycap and the connecting plate. The supporting plate is disposed under the connecting plate. The connecting plate, the scissors-type connecting element and the keycap are supported by the supporting plate. The supporting plate includes an accommodation part and an elastic structure. The accommodation part is protruded from a top surface of the supporting plate. The elastic structure is disposed within the accommodation part and partially exposed outside the accommodation part so as to be contacted with the protrusion part. When the keycap is depressed, the protrusion part is moved with the keycap, so that the elastic structure is collided by the protrusion part and a sound is generated.

In accordance with another aspect of the present invention, there is provided a key structure. The key structure includes a keycap, a scissors-type connecting element, and a supporting plate. The keycap includes a protrusion part. The protrusion part is protruded from an inner surface of the keycap. The scissors-type connecting element is connected with the keycap. The supporting plate is disposed under the keycap and connected with the scissors-type connecting element. The supporting plate includes an accommodation part and an elastic structure. The accommodation part is protruded from a top surface of the supporting plate. The elastic structure is disposed within the accommodation part and partially exposed outside the accommodation part so as to be contacted with the protrusion part. When the keycap is depressed, the protrusion part is moved with the keycap, so that the elastic structure is collided by the protrusion part and a sound is generated.

From the above descriptions, the present invention provides the key structure. The key structure uses the conventional scissors-type connecting element to activate the keycap, and the triggering element made of a soft material (e.g., rubber) to trigger the membrane switch circuit member. Consequently, the tactile feel of depressing the keycap is enhanced. Moreover, since both of the triggering element and the membrane switch circuit member are thinner than the mechanical triggering switch of the conventional mechanical key structure, the key structure of the present invention has a smaller thickness and slimmer appearance. Moreover, in the key structure of the present invention, the keycap is equipped with the protrusion part and the supporting plate is equipped with the elastic structure. When the keycap is depressed by the user, the protrusion part can collide with the elastic structure to generate a click sound like the conventional mechanical key structure. Consequently, the key structure of the present invention can certainly provide the depressing feedback to the user.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For solving the drawbacks of the conventional technologies, the present invention provides a key structure capable of providing a feedback feel and having enhanced tactile feel and slim appearance.

Figure 1:
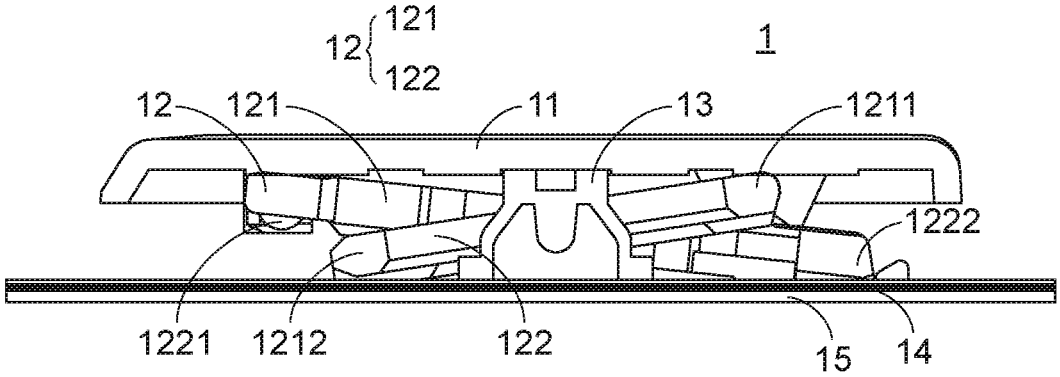
FIG.1 PRIOR ART
FIG. 1 is a schematic side cross-sectional view illustrating a conventional key structure.
Figure 2:
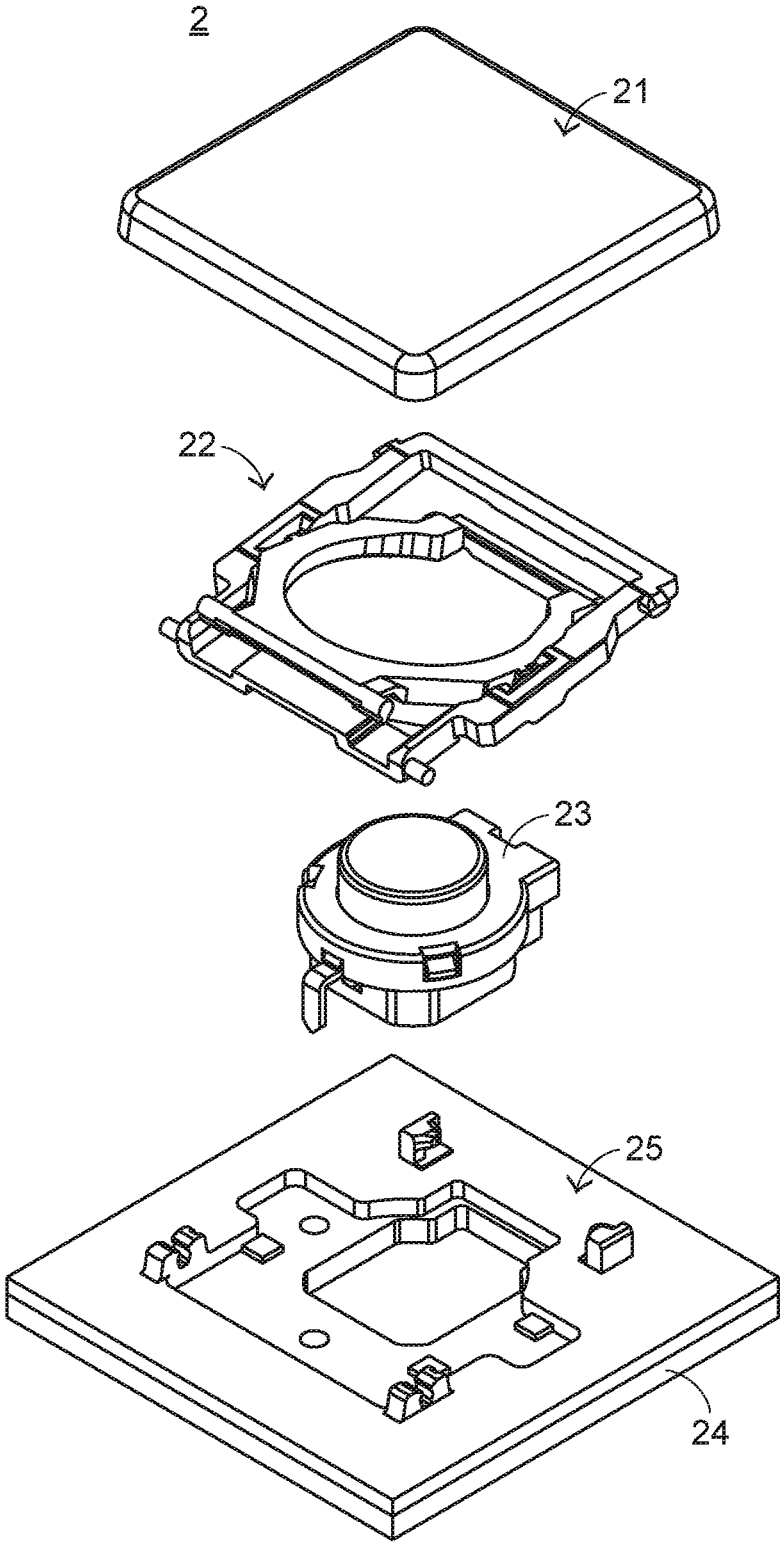
FIG.2 PRIOR ART
FIG. 2 is a schematic side cross-sectional view illustrating a conventional mechanical key structure.
Figure 3:
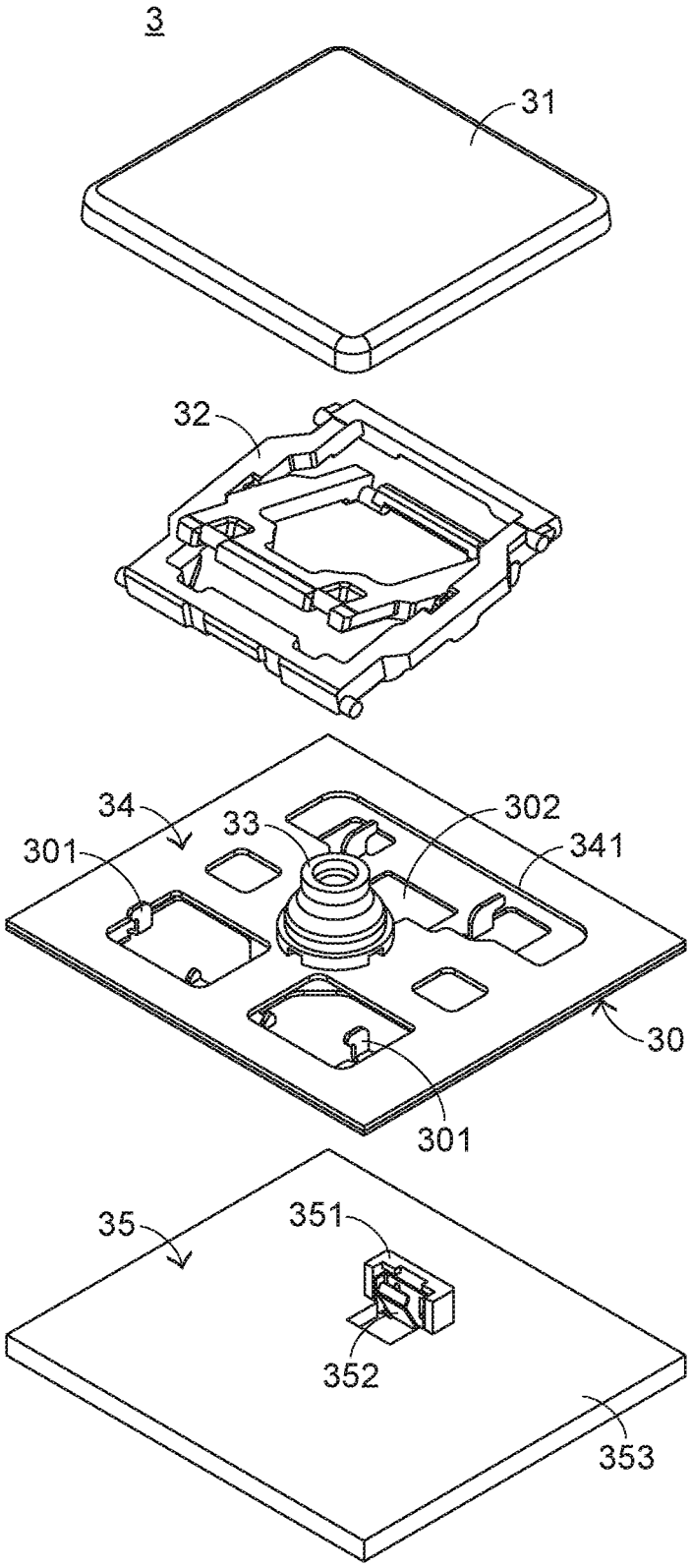
FIG. 3 is a schematic exploded view illustrating a key structure according to a first embodiment of the present invention.
Figure 4:
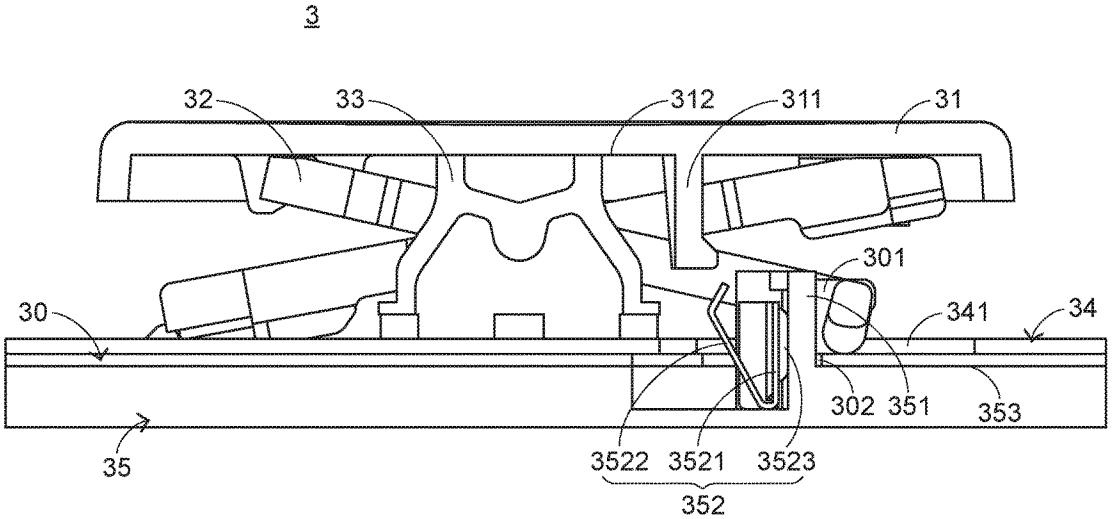
FIG. 4 is a schematic side cross-sectional view illustrating the key structure according to the first embodiment of the present invention, in which the keycap is not depressed.

FIG. 3 is a schematic exploded view illustrating a key structure according to a first embodiment of the present invention. FIG. 4 is a schematic side cross-sectional view illustrating the key structure according to the first embodiment of the present invention, in which the keycap is not depressed. As shown in FIGS. 3 and 4, the key structure 3 comprises a connecting plate 30, a keycap 31, a scissors-type connecting element 32, a triggering element 33, a membrane switch circuit member 34 and a supporting plate 35. The keycap 31 is disposed over the connecting plate 30. The keycap 31 is movable relative to the connecting plate 30. Moreover, the keycap 31 comprises a protrusion part 311. The protrusion part 311 is protruded externally (e.g., downwardly as shown in FIG. 4) from an inner surface 312 of the keycap 31. The scissors-type connecting element 32 is connected with the keycap 31 and the connecting plate 30. Moreover, the scissors-type connecting element 32 is moved with the keycap 31. Preferably but not exclusively, the protrusion part 311 is integrally formed with the keycap 31, and the keycap 31 is made of a plastic material. In another embodiment, the protrusion part is fixed on the inner surface of the keycap by a hot melt process. Moreover, the material of the protrusion part is not restricted to the plastic material.

The supporting plate 35 is disposed under the connecting plate 30. The connecting plate 30, the keycap 31, the scissors-type connecting element 32, the triggering element 33 and the membrane switch circuit member 34 are supported by the supporting plate 35. The supporting plate 35 comprises an accommodation part 351 and an elastic structure 352. The accommodation part 351 is protruded externally (e.g., upwardly as shown in FIG. 4) from a top surface 353 of the supporting plate 35. The accommodation part 351 has a concave structure for accommodating the elastic structure 352. The elastic structure 352 is disposed within the accommodation part 351, and partially exposed outside the accommodation part 351. When the keycap 31 is depressed, the elastic structure 352 is contacted with the protrusion part 311.

Moreover, the connecting plate 30 comprises plural fixing hooks 301 and a connecting plate opening 302. The plural fixing hooks 301 are disposed on a top surface of the connecting plate 30 and coupled with the scissors-type connecting element 32. The connecting plate opening 302 is aligned with the accommodation part 351. When the connecting plate 30 is supported on the supporting plate 35, the accommodation part 351 is penetrated through the connecting plate opening 302. The membrane switch circuit member 34 is disposed on the connecting plate 30. When the keycap 31 is depressed, a key signal corresponding to the keycap 31 is generated by the membrane switch circuit member 34. The membrane switch circuit member 34 comprises a membrane opening 341 corresponding to the accommodation part 351. Consequently, as shown in FIG. 4, the accommodation part 351 is sequentially penetrated through the connecting plate opening 302 and the membrane opening 341. The triggering element 33 is arranged between the keycap 31 and the membrane switch circuit member 34. When the triggering element 33 is pushed by the keycap 31, the membrane switch circuit member 34 is triggered by the triggering element 33. In an embodiment, the triggering element 33 is a rubbery elastomer, and the membrane switch circuit member 34 is disposed over the connecting plate 30. It is noted that numerous modifications and alterations may be made while retaining the teachings of the invention. For example, in another embodiment, the membrane switch circuit member is disposed under the connecting plate. Under this circumstance, the connecting plate has a perforation for allowing the triggering element to pass through.

As shown in FIG. 4, the components of the key structure 3 from top to bottom include the keycap 31, the scissors-type connecting element 32, the membrane switch circuit member 34, the connecting plate 30 and the supporting plate 35 sequentially. The triggering element 33 is arranged between the keycap 31 and the membrane switch circuit member 34. Moreover, the triggering element 33 is enclosed by the scissors-type connecting element 32. Moreover, the accommodation part 351 is sequentially penetrated through the connecting plate opening 302 and the membrane opening 341.

Figure 5:
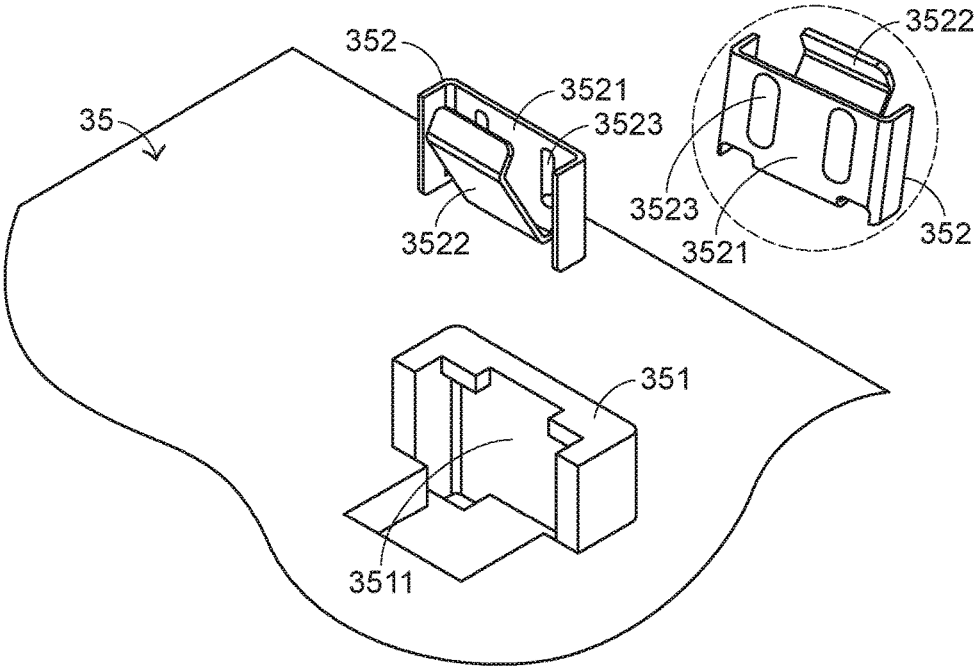
FIG. 5 is a schematic exploded view illustrating the accommodation part and the elastic structure of the key structure according to the first embodiment of the present invention.
Figure 6:
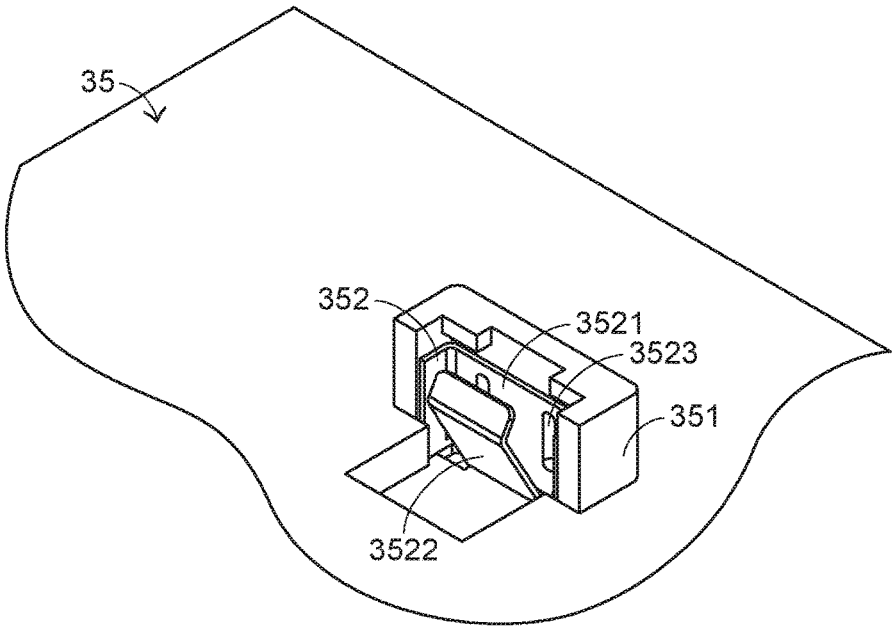
FIG. 6 is a schematic assembled view illustrating the accommodation part and the elastic structure of the key structure according to the first embodiment of the present invention.

The structures of the accommodation part 351 and the elastic structure 352 will be illustrated in more details as follows. FIG. 5 is a schematic exploded view illustrating the accommodation part and the elastic structure of the key structure according to the first embodiment of the present invention. As shown in FIG. 5, the elastic structure 352 comprises a main body 3521, an elastic sheet 3522 and a collision part 3523. The elastic sheet 3522 is connected with the main body 3521. Moreover, the elastic sheet 3522 can be swung relative to the main body 3521. When the keycap 31 is depressed, the elastic sheet 3522 is collided by the protrusion part 311. Consequently, the elastic sheet 3522 is swung relative to the main body 3521 and generates a sound. The collision part 3523 is disposed on the main body 3521 and located near the accommodation part 351. When the elastic sheet 3522 is collided by the protrusion part 311, the main body 3521 is subjected to tiny vibration. Consequently, an inner surface 3511 of the accommodation part 351 is collided by the collision part 3523, and the sound is further generated. In this embodiment, all of the main body 3521, the elastic sheet 3522 and the collision part 3523 are made of a metallic material. Moreover, the main body 3521, the elastic sheet 3522 and the collision part 3523 are integrally formed with each other. After the elastic structure 352 is accommodated within the accommodation part 351, the combination structure of the accommodation part 351 and the elastic structure 352 is shown in FIG. 6.

Figure 7:
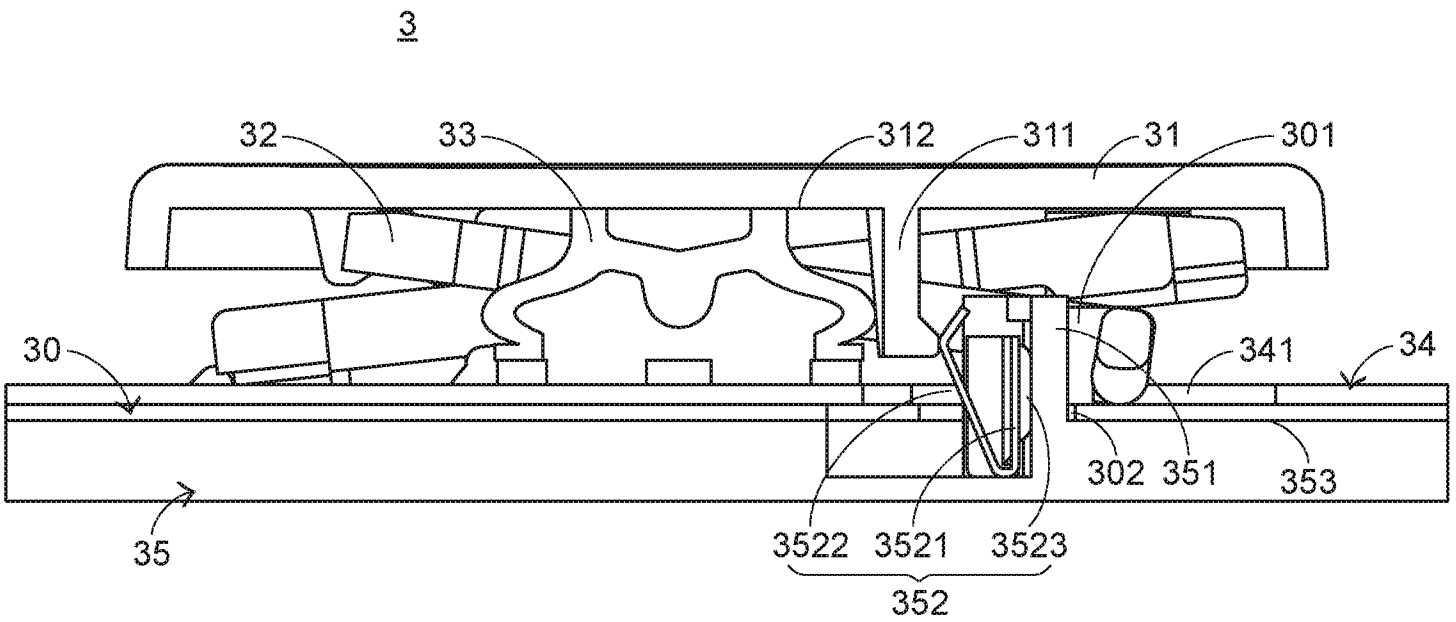
FIG. 7 is a schematic side cross-sectional view illustrating the key structure according to the first embodiment of the present invention, in which the keycap is depressed.

Please refer to FIG. 4 again. The operations of the conventional key structure 3 in response to the depressing action of the user will be illustrated as follows. FIG. 7 schematically illustrates the key structure 3 when the keycap 31 is depressed. When the keycap 31 is depressed, the keycap 31 is moved downwardly to push the scissors-type connecting element 32 in response to the depressing force. Consequently, the scissors-type connecting element 32 is activated. As the keycap 31 is moved downwardly relative to the connecting plate 30 to push the triggering element 33, the triggering element 33 is subjected to deformation to push the membrane switch circuit member 34 and trigger the corresponding key intersection (not shown) of the membrane switch circuit member 34. Consequently, the membrane switch circuit member 34 generates a corresponding key signal. While the keycap 31 is moved downwardly, the protrusion part 311 is moved downwardly with the keycap 31. Consequently, the protrusion part 311 collides with the elastic sheet 3522 of the elastic structure 352 to generate a sound. When the elastic sheet 3522 is collided by the protrusion part 311, the main body 3521 is subjected to tiny vibration. Consequently, the inner surface 3511 of the accommodation part 351 is collided by the collision part 3523, and the sound is further generated.

When the keycap 31 is no longer depressed by the user, no external force is applied to the keycap 31 and the triggering element 33 is no longer pushed by the keycap 31. In response to the elasticity of the triggering element 33, the triggering element 33 is restored to its original shape to provide an upward elastic restoring force. In response to the upward elastic restoring force, the keycap 31 is returned to its original position where it is not depressed. Meanwhile, the protrusion part 311 is no longer contacted with the elastic sheet 3522, and returned to its original position.

Figure 8:
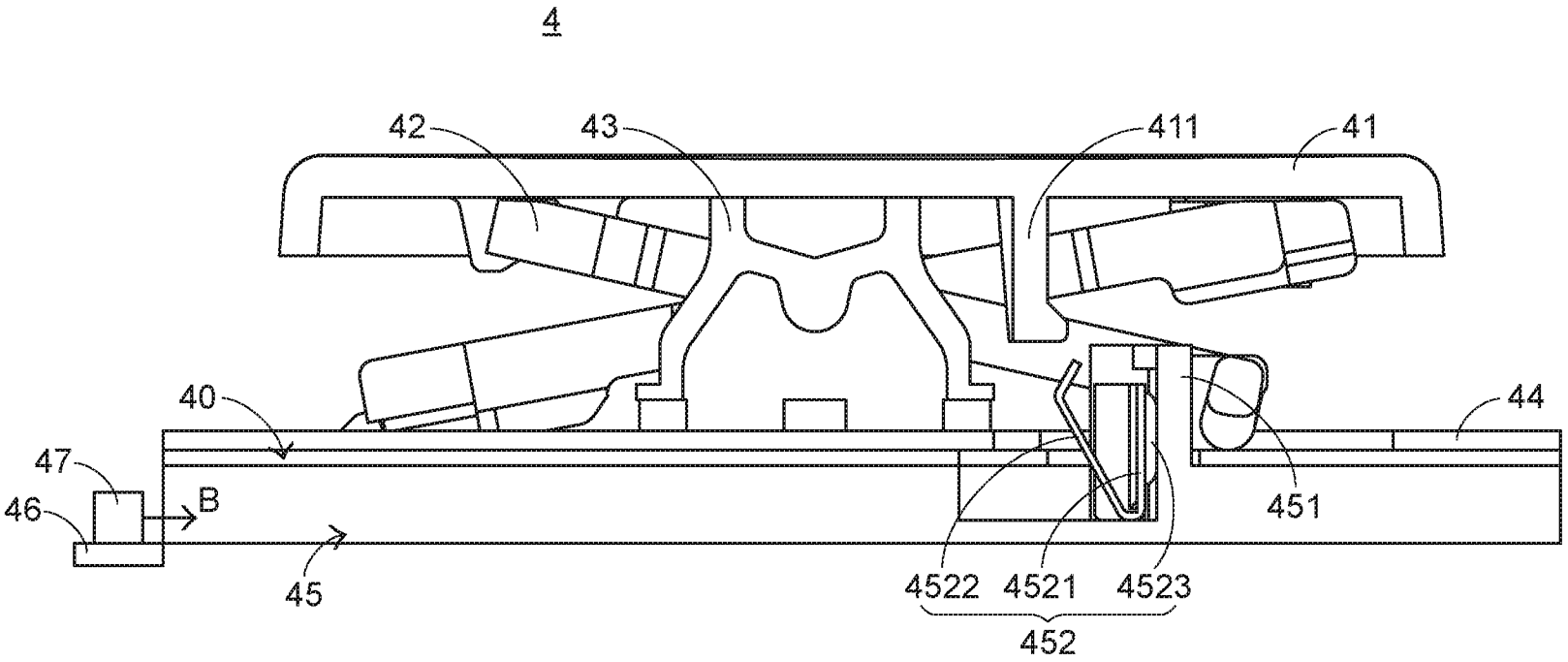
FIG. 8 is a schematic side cross-sectional view illustrating a key structure according to a second embodiment of the present invention, in which the keycap is not depressed.

The present invention further provides a second embodiment, which is distinguished from the first embodiment. FIG. 8 is a schematic side cross-sectional view illustrating a key structure according to a second embodiment of the present invention, in which the keycap is not depressed. As shown in FIG. 8, the key structure 4 comprises a connecting plate 40, a keycap 41, a scissors-type connecting element 42, a triggering element 43, a membrane switch circuit member 44, a supporting plate 45, a circuit board 46 and a light-emitting element 47. The keycap 41 comprises a protrusion part 411. Moreover, the supporting plate 45 comprises an accommodation part 451 and an elastic structure 452. The elastic structure 452 comprises a main body 4521, an elastic sheet 4522 and a collision part 4523. The structures and functions of the components of the key structure 4 which are identical to those of the first embodiment are not redundantly described herein. In comparison with the first embodiment, the key structure 4 of this embodiment further comprises the circuit board 46 and the light-emitting element 47.

The circuit board 46 is located beside the supporting plate 45 for providing electricity to the light-emitting element 47. The light-emitting element 47 is disposed on the circuit board 46. The light-emitting element 47 is used for emitting light beams B and projecting the light beams B into the supporting plate 45. In an embodiment, the light-emitting element 47 is a light emitting diode, and the supporting plate 45 is made of a light-guiding material. The light beams B can be guided to the keycap 41 by the supporting plate 45. Consequently, the key structure 4 has an illuminating function. The operations of the key structure 4 are similar to those of the first embodiment, and are not redundantly described herein. It is noted that numerous modifications and alterations may be made while retaining the teachings of the invention. For example, in another embodiment, the circuit board, the light-emitting element and the supporting plate (i.e., a light guide plate) are disposed over the connecting plate and the membrane switch circuit member. That is, these components are not restricted to be disposed under the connecting plate.

Figure 9:
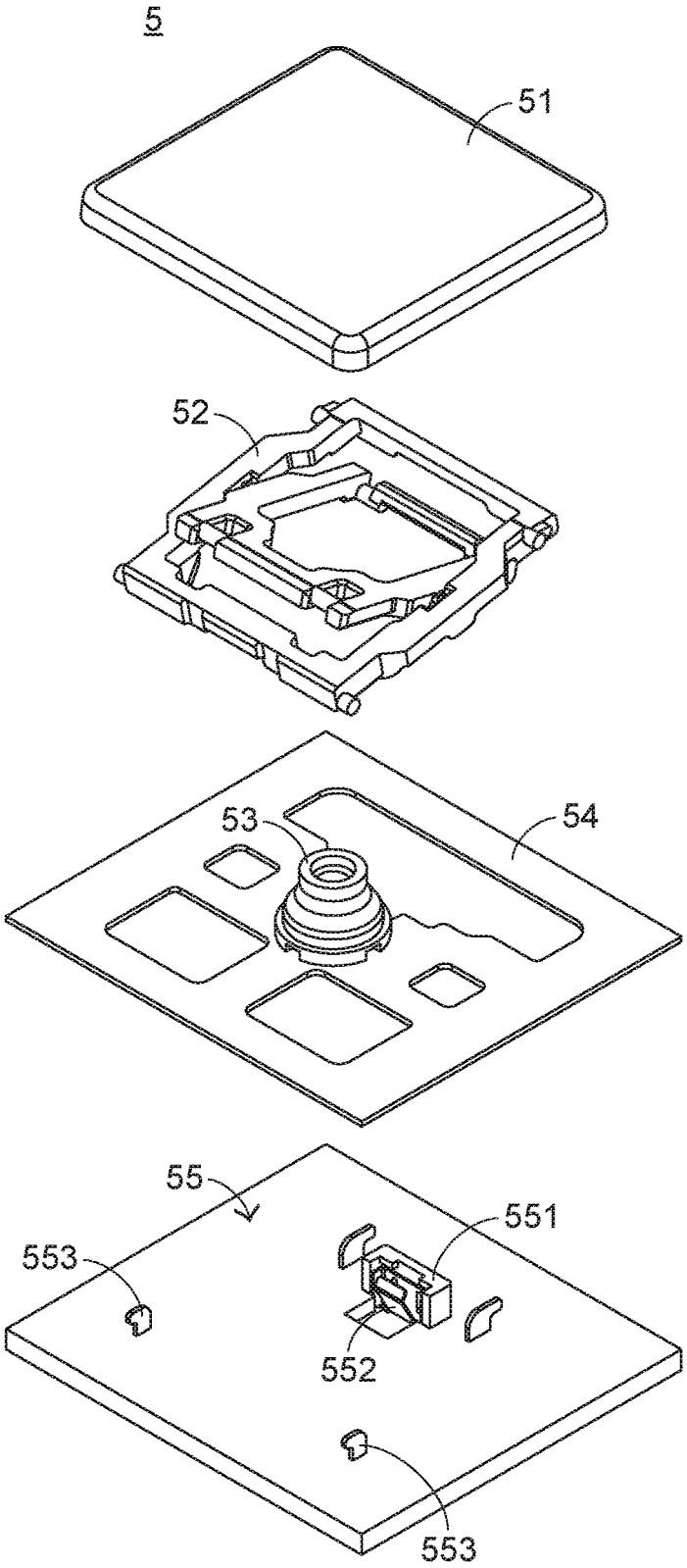
FIG. 9 is a schematic exploded view illustrating a key structure according to a third embodiment of the present invention.
Figure 10:
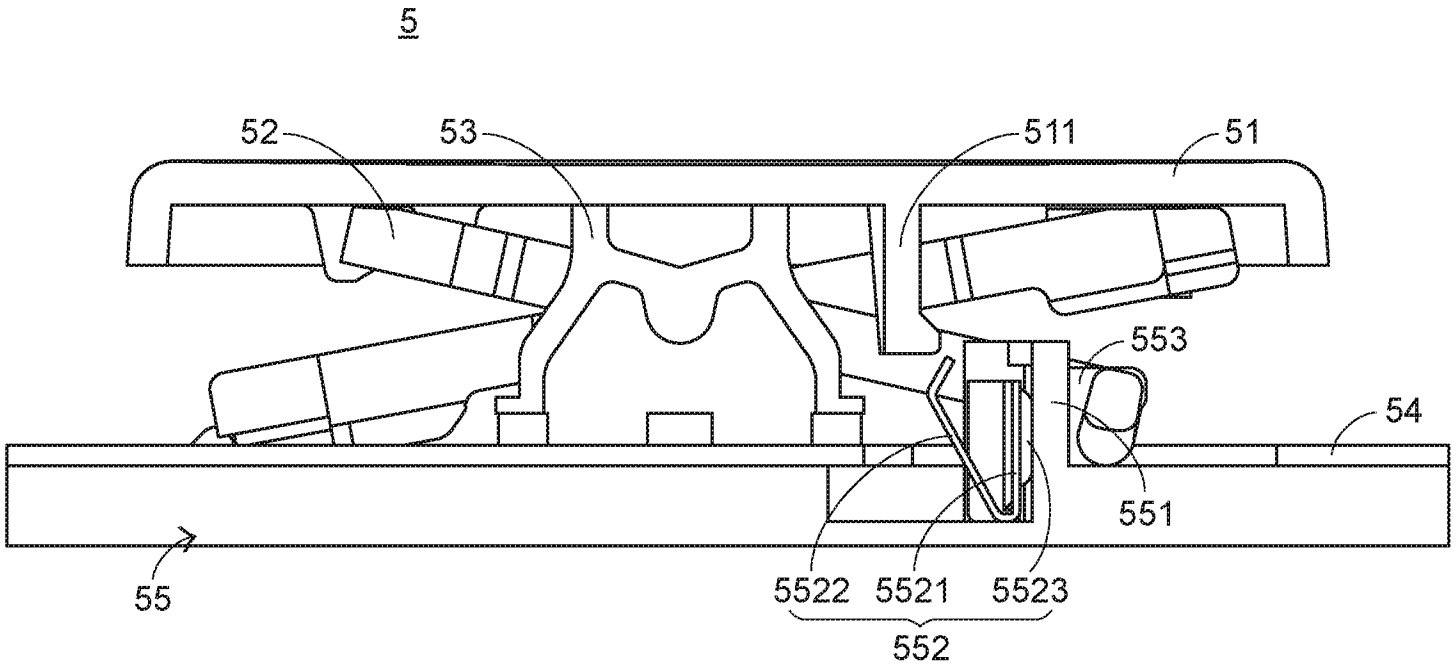
FIG. 10 is a schematic side cross-sectional view illustrating the key structure according to the third embodiment of the present invention, in which the keycap is not depressed.

The present invention further provides a third embodiment, which is distinguished from the above embodiments. FIG. 9 is a schematic exploded view illustrating a key structure according to a third embodiment of the present invention. FIG. 10 is a schematic side cross-sectional view illustrating the key structure according to the third embodiment of the present invention, in which the keycap is not depressed. As shown in FIGS. 9 and 10, the key structure 5 comprises a keycap 51, a scissors-type connecting element 52, a triggering element 53, a membrane switch circuit member 54 and a supporting plate 55. The keycap 51 comprises a protrusion part 511. The supporting plate 55 comprises an accommodation part 551, an elastic structure 552 and plural fixing hooks 533. The elastic structure 552 comprises a main body 5521, an elastic sheet 5522 and a collision part 5523. The structures and functions of the components of the key structure 5 which are identical to those of the first embodiment are not redundantly described herein. In comparison with the above embodiments, the key structure 5 of this embodiment is not equipped with the connecting plate.

As shown in FIGS. 9 and 10, the plural fixing hooks 353 are disposed on the supporting plate 55 and coupled with the scissors-type connecting element 52. In this embodiment, the plural fixing hooks 353 are integrally formed with the supporting plate 55. In other words, the supporting plate 55 of the key structure 5 can replace the function of the connecting plate. Moreover, the membrane switch circuit member 54 is disposed on the supporting plate 55. The components of the key structure 5 from top to bottom include the keycap 51, the scissors-type connecting element 52, the membrane switch circuit member 54 and the supporting plate 55 sequentially. The triggering element 53 is arranged between the keycap 51 and the membrane switch circuit member 54. Moreover, the triggering element 53 is enclosed by the scissors-type connecting element 52.

The operations of the conventional key structure 5 in response to the depressing action of the user will be illustrated as follows. When the keycap 51 is depressed, the keycap 51 is moved downwardly relative to the supporting plate 55 in response to the depressing force. As the keycap 51 is moved downwardly to push the triggering element 53, the triggering element 53 is subjected to deformation to push the membrane switch circuit member 54 and trigger the corresponding key intersection (not shown) of the membrane switch circuit member 54. The operations of the protrusion part 511 of the keycap 51 to collide with the elastic structure 552 are similar to those of the above embodiments, and are not redundantly described herein.

When the keycap 51 is no longer depressed by the user, no external force is applied to the keycap 51 and the triggering element 53 is no longer pushed by the keycap 51. In response to the elasticity of the triggering element 53, the triggering element 53 is restored to its original shape to provide an upward elastic restoring force. In response to the upward elastic restoring force, the keycap 51 is returned to its original position where it is not depressed. Meanwhile, the protrusion part 511 is no longer contacted with the elastic sheet 5522, and returned to its original position.

In this embodiment, the supporting plate 5 of the key structure 5 is equipped with the plural fixing hooks 533. Consequently, the connecting plate is omitted. Under this circumstance, the installation cost of the connecting plate is saved, and the overall thickness of the key structure 5 is reduced. Moreover, in case that the key structure 5 is equipped with a circuit board and a light-emitting element, the key structure 5 has the illuminating function.

From the above descriptions, the present invention provides the key structure. The key structure uses the conventional scissors-type connecting element to activate the keycap, and the triggering element made of the soft material (e.g., rubber) to trigger the membrane switch circuit member. Consequently, the tactile feel of depressing the keycap is enhanced. Moreover, since both of the triggering element and the membrane switch circuit member are thinner than the mechanical triggering switch of the conventional mechanical key structure, the key structure of the present invention has a smaller thickness and slimmer appearance. Moreover, in the key structure of the present invention, the keycap is equipped with the protrusion part and the supporting plate is equipped with the elastic structure. When the keycap is depressed by the user, the protrusion part can collide with the elastic structure to generate a click sound like the conventional mechanical key structure. Consequently, the key structure of the present invention can certainly provide the depressing feedback to the user.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a connecting plate;

a keycap disposed over the connecting plate, and movable relative to the connecting plate, wherein the keycap comprises a protrusion part, and the protrusion part is protruded from an inner surface of the keycap;

a scissors-type connecting element connected with the keycap and the connecting plate; and a supporting plate disposed under the connecting plate, wherein the connecting plate, the scissors-type connecting element and the keycap are supported by the supporting plate, wherein the supporting plate comprises:

an accommodation part protruded from a top surface of the supporting plate; and an elastic structure disposed within the accommodation part and partially exposed outside the accommodation part so as to be contacted with the protrusion part, wherein when the keycap is depressed, the protrusion part is moved with the keycap, so that the elastic structure is collided by the protrusion part and a sound is generated, wherein the elastic structure comprises:

a main body;

an elastic sheet connected with the main body, and permitted to be swung relative to the main body, wherein when the elastic sheet is collided by the protrusion part, the elastic sheet is swung relative to the main body and the sound is generated; and a collision part disposed on the main body and located near the accommodation part, wherein when the elastic sheet is collided by the protrusion part, an inner surface of the accommodation part is collided by the collision part and the sound is generated.

2. The key structure according to claim 1, wherein the main body, the elastic sheet and the collision part are made of a metallic material, and integrally formed with each other.

3. The key structure according to claim 1, further comprising:

a circuit board located beside the supporting plate; and a light-emitting element disposed on the circuit board, and emitting light beams and projecting the light beams to the supporting plate, wherein the supporting plate is made of a light-guiding material, and the light beams are guided to the keycap by the supporting plate.

4. The key structure according to claim 1, wherein the connecting plate comprises:

plural fixing hooks disposed on a top surface of the connecting plate, and coupled with the scissors-type connecting element, wherein the plural fixing hooks are integrally formed with the connecting plate; and a connecting plate opening aligned with the accommodation part, wherein when the connecting plate is supported on the supporting plate, the accommodation part is penetrated through the connecting plate opening.

5. The key structure according to claim 1, further comprising:

a membrane switch circuit member disposed on the connecting plate, wherein as the keycap is moved, a key signal corresponding to the keycap is generated by the membrane switch circuit member; and a triggering element arranged between the keycap and the membrane switch circuit member, wherein when the triggering element is pushed by the keycap, the membrane switch circuit member is triggered by the triggering element.

6. The key structure according to claim 5, wherein when the keycap is depressed, the keycap is moved downwardly relative to the connecting plate to push the triggering element, and the triggering element is subjected to deformation to trigger the membrane switch circuit member, so that the membrane switch circuit member generates the key signal, wherein when the keycap is no longer depressed, the triggering element is restored to an original shape and provides an elastic restoring force, and the keycap is moved to an original position in response to the elastic restoring force, wherein the triggering element is a rubbery elastomer.

7. A key structure, comprising:

a keycap comprising a protrusion part, wherein the protrusion part is protruded from an inner surface of the keycap;

a scissors-type connecting element connected with the keycap; and a supporting plate disposed under the keycap and connected with the scissors-type connecting element, wherein the supporting plate comprises:

an accommodation part protruded from a top surface of the supporting plate; and an elastic structure disposed within the accommodation part and partially exposed outside the accommodation part so as to be contacted with the protrusion part, wherein when the keycap is depressed, the protrusion part is moved with the keycap, so that the elastic structure is collided by the protrusion part and a sound is generated, wherein the elastic structure comprises:

a main body;

an elastic sheet connected with the main body, and permitted to be swung relative to the main body, wherein when the elastic sheet is collided by the protrusion part, the elastic sheet is swung relative to the main body and the sound is generated; and a collision part disposed on the main body and located near the accommodation part, wherein when the elastic sheet is collided by the protrusion part, an inner surface of the accommodation part is collided by the collision part and the sound is generated.

8. The key structure according to claim 7, wherein the main body, the elastic sheet and the collision part are made of a metallic material, and integrally formed with each other.

9. The key structure according to claim 7, further comprising:

a circuit board located beside the supporting plate; and a light-emitting element disposed on the circuit board, and emitting light beams and projecting the light beams to the supporting plate, wherein the supporting plate is made of a light-guiding material, and the light beams are guided to the keycap by the supporting plate.

10. The key structure according to claim 7, wherein the supporting plate further comprises plural fixing hooks, wherein the plural fixing hooks are disposed on the top surface of the supporting plate and coupled with the scissors-type connecting element.

11. The key structure according to claim 7, further comprising:

a membrane switch circuit member disposed on the supporting plate, wherein as the keycap is moved, a key signal corresponding to the keycap is generated by the membrane switch circuit member; and a triggering element arranged between the keycap and the membrane switch circuit member, wherein when the triggering element is pushed by the keycap, the membrane switch circuit member is triggered by the triggering element.

12. The key structure according to claim 11, wherein when the keycap is depressed, the keycap is moved downwardly relative to the supporting plate to push the triggering element, and the triggering element is subjected to deformation to trigger the membrane switch circuit member, so that the membrane switch circuit member generates the key signal, wherein when the keycap is no longer depressed, the triggering element is restored to an original shape and provides an elastic restoring force, and the keycap is moved to an original position in response to the elastic restoring force, wherein the triggering element is a rubbery elastomer.

* * * * *